United States Patent [19]

Meyer

[11] Patent Number: 4,465,455

[45] Date of Patent: Aug. 14, 1984

[54] START-UP/SHUT-DOWN FOR A HYDROGEN GAS BURNER

[76] Inventor: Stanley A. Meyer, 3792 Broadway Blvd., Grove City, Ohio 43123

[21] Appl. No.: 422,875

[22] Filed: Sep. 24, 1982

[51] Int. Cl.[3] ..... F23N 5/00

[52] U.S. Cl. ..... 431/27; 431/66; 431/70; 431/78

[58] Field of Search ..... 431/27, 46, 66, 67, 431/69–71, 72, 74, 78–80; 123/3, 1 A, DIG. 12; 204/129

[56] References Cited

U.S. PATENT DOCUMENTS

| | | | |
|---|---|---|---|
| 2,954,080 | 9/1960 | Prouty et al. | 431/67 |
| 3,086,583 | 4/1963 | Rerchow | 431/46 |
| 3,980,053 | 9/1976 | Horvath | 123/3 |
| 4,056,348 | 11/1977 | Wolfe | 431/66 |

*Primary Examiner*—Lee E. Barrett
*Attorney, Agent, or Firm*—Anthony D. Cennamo

[57] ABSTRACT

System for flame start-up/shut-down for a hydrogen gas mixture burner. An electrical probe igniter positioned adjacent the gas port outlet. On demand the igniter is actuated to heat and electrically heat a thermal switch. Responsive electronic controls actuate the appropriate valves and circuits for operational start-up. Upon the ignition of the generated hydrogen gas mixture, a second thermal probe is heated by the flame to deactivate the ignition and start-up circuits. After demand the second thermal probe cools and the circuit is restored for start-up again. A safety probe positioned in the flame is quiescent. In the event of demand time shut-down, the safety probe will activate the circuits for restart. If failure to start-up continues for a predetermined time, the safety probe circuit will effect permanent shut-down.

3 Claims, 2 Drawing Figures

START-UP/SHUT-DOWN FOR A HYDROGEN GAS BURNER

CROSS REFERENCES

In the non-electrolysis process disclosed and claimed in my co-pending patent application, Ser. No. 302,807, Filed: Sept. 16, 1981, For:HYDROGEN GENERATOR SYSTEM, for separating hydrogen and oxygen atoms from water, water is passed between two plates of similar non-oxidizing metal. The one plate has placed thereon a positive potential and the other a negative potential from a very low-direct-current power source. The sub-atomic action of the direct current voltage causes the hydrogen and oxygen atoms to be separated. The contaminants in the water are forced also to disassociate itself and may be collected or utilized and disposed of. This in turn lends the process to recombining the hydrogen and oxygen into pure water.

The direct current voltage applied to the plates is non-regulated and non-filtered. The direct current acts as a static force on the water molecules; whereas the rippling direct current voltage acts as a dynamic force. Pulsating the direct current further acts as a dynamic force and enhances considerably the splitting of the atoms from the water molecules. An increase in voltage potential further increases the hydrogen output. Certain plate arrangements and configurations with graphical illustration or relative efficiency are disclosed.

In my co-pending patent application, Ser. No. 422,495, Filed: Sept. 24, 1982, For: PERIODIC FLUSH SYSTEM FOR NON-ELECTROLYSIS HYDROGEN GENERATOR, there is disclosed control apparatus and electrical circuitry for periodically shutting down the hydrogen generator for flushing out the accumulated contamianats. The shut-down is in a sequential step-by-step operation. After the flushing is complete, the hydrogen generator is started up and, again, in a sequential step-by-step operation. Although the functions are numerous, the most critical is the opening and closing of the gas valves, and the switching on and off of the electrical circuitry to the exciter elements.

BACKGROUND

Heating and air environmental systems of the prior art have included sensing systems for flame-out, power loss or the like. These systems do provide some form of shut-down upon occurrence of a malfunction.

However, the prior art systems are either of gas, oil, or electrical. Although a gas or oil furnace will utilize electrical circuitry for a blower, the energy, whether gas, oil, or electric, is supplied either by a utility or in bulk. None of the prior art systems generate the energy that is used in the heating or air control system. Accordingly, no monitoring systems for the generator systems are known in the prior art, that are applicable heating or air control systems.

SUMMARY OF INVENTION

The present invention in its preferred embodiment provides a monitoring system and a start-up/shut-down circuitry and apparatus for a hydrogen gas burner. The system is distinctive in that the hydrogen generator is a demand system; that is, hydrogen gas is generated only when the thermostat (or other gauge) dictates the energy is needed. Accordingly, the start-up is the start-up of the energy generating system and thereafter starting the igniter to ignite the hydrogen gas mixture. Further, although the prior systems start-up on demand; none have a need for periodic shut-down.

The present invention is a start-up/shut-down system for an energy generator and for the utilization of the energy generated. The function in addition to demand is periodic. Then, again, the same procedure is followed upon the occurrence of malfunction.

The apparatus comprises an igniter in the flame path that upon actuation heats a thermal probe that controls the electrical/electronic circuitry for opening and closing the various controls and switches. Another probe deactivates the ignition and start-up upon completing the function. A safety probe positioned in the flame path is time controlled to start-up in the occurrence of a flame-out, if failure occurs in the attempt to retract within a given period of time the entire system is shut-down.

OBJECTS

It is a principal object of the present invention to provide a monitoring and control system for start-up and shut-down of an energy generator system.

Another object of the present invention is to provide such a control system that is operable upon demand, periodically operable, and operable upon occurrence of a malfunction.

A further object of the invention is for a monitoring and control system that distinguishes between an accidental flame-out and a flame-out caused by malfunction of the system.

A further object of the invention is for a monitoring and control system that provides a restart function upon accidental flame-out.

Other objects and features of the present invention will become apparent from the following detailed description when taken in conjunction with the drawings in which:

DETAILED DESCRIPTION OF DRAWINGS

Figure 1:
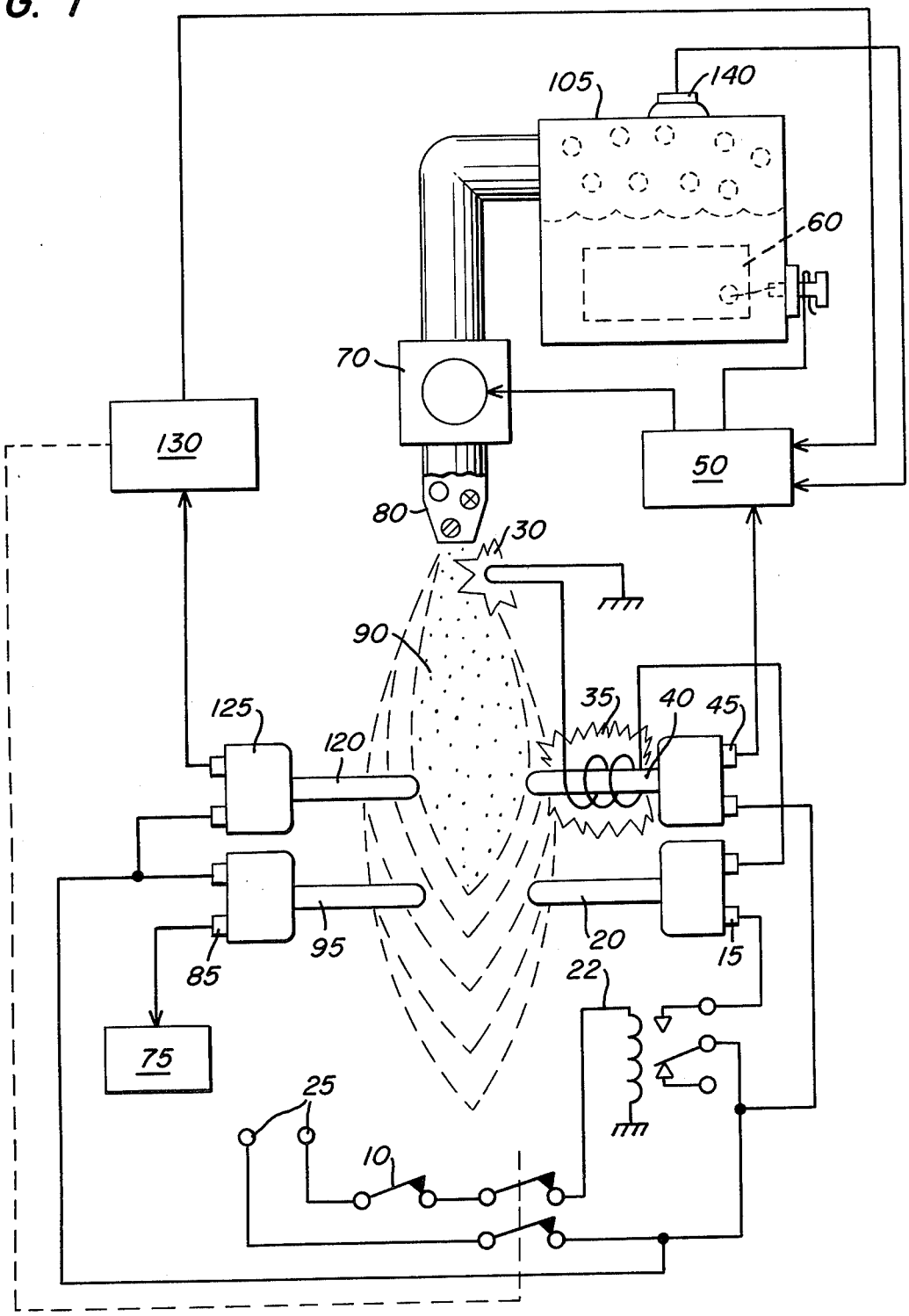
FIG. 1 schematically depicts a preferred embodiment of the invention of a hydrogen gas mixture burner incorporating the features of the invention.
Figure 2:
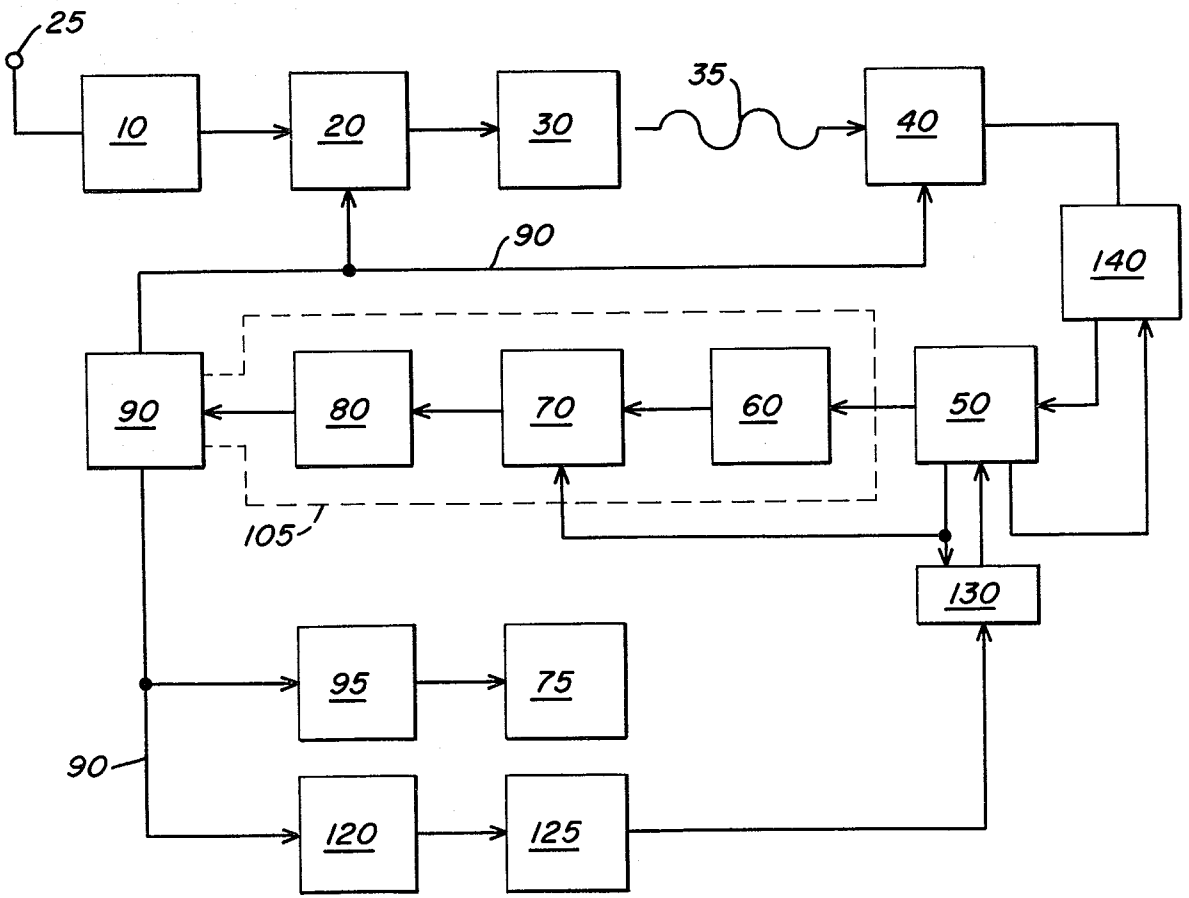
FIG. 2 is a schematic block diagram of the preferred embodiment in a complete operational generator system.

With reference to FIG. 1 there is a illustrated schematically the mechanical/electrical apparatus of the system of the preferred embodiment of the invention taken in conjunction with the hydrogen generator of my co-pending patent application, supra. In FIG. 2 the electrical circuitry and actuating valves and the like are depicted in a sequential schematic block type of arrangement.

Referring to FIG. 1, together with FIG. 2, the preferred embodiment of the present invention may now be described. The thermal probe switch 20, before start-up, is in a normally closed position. Upon the demand for energy, dictated by the thermostat 10 control, the relay 22 is closed, applying electrical power from source 25 to the electrical spark igniter 30 through the closed thermal probe 20. Upon the spark igniter 30 attaining the appropriate temperature, the radiant heat from coil 35 heats the thermal probe 40.

As the thermal probe 40 heats, the normally open switch 45 closes and in turn actuates the electrical control circuit 50. The control circuit 50 closes the circuit to apply electrical power to the exciters 60 in the non-electrolysis hydrogen generator 105.

In sequence, and upon attaining appropriate pressure from the gasses generated as indicated by pressure valve in the hydrogen generator 105, also illustrated in FIG. 2 in dotted line block, the gas outlet valve 70 is opened, permitting gas to be expelled through a nozzle assembly 80.

Upon the gas making contact with the heated electrical spark igniter 30, the hydrogen gas mixture, expelled from the controlled port opening in nozzle assembly 80 is ignited into a continuous extremely high temperature flame 90.

The thermal probe 95 immediately begins to heat and after attaining the predetermined temperature the fan assembly 75 is actuated by the closure of relay 85.

The flame 90 having been ignited and burning, causes the thermal probe 20 to become heated and thereby opening its relay 15. In turn, the voltage applied to the electrical spark igniter 30 is terminated by the open relay 15.

Upon the demand from the thermostat 10 being reached the relay 22 is opened thereby cutting off the voltage 25 to the thermal probe switch 20. Sequentially the electrical control circuit 50 opens the circuit providing voltage to the exciters 60; thereby shutting gas outlet valve 70 to terminate the flame 90. Thereafter the circuit is ready for start-up again upon demand from the thermostat 10, as aforesaid.

A safety probe 120 is also positioned in the flame 90. During operation of the system under demand from the thermostat control 10, the probe 120 will remain heated. In this condition the attendant relay 130 is inoperative. If for some reason the flame 90 should be extinguished during the demand period the safety probe 120 will quickly cool and in sequence the attendant relay 130 will open. Relay 130 connected to relay 22 in the power circuit will act in place of the demand thermostat 10, that is, the relay 130 will override the demand thermostat 10. The circuits and functions will follow as above-described for start-up in the event the flame-out was accidental.

The safety control system further includes a timer circuit and thermostat 125 that will permit the probe 120 to attain its temperature within a given period of time. If the probe 120 does not attain its temperature the same start-up procedure will follow again, within a given period of time. The timer 125 is so set that unless the probe 120 attains the appropriate temperature within the given period of time the entire circuitry is shut down permanently. This denotes a major failure in the system and not a simple flame-out.

Finally, in the unlikely event of pressure build-up upon malfunction, there is provided a safety relief valve 140.

I claim:

1. A start-up/shut/down circuit for activating and deactivating a non-ionic hydrogen generator burner system on demand, comprising:

a thermostatic control demand circuit, a gas nozzle connected to the generated gas output of said hydrogen generator and a controlled size port in said nozzle for confining and controlling the hydrogen gas expelled therefrom, an igniter positioned in the projective path of said nozzle, an electrical heating element adjacent said igniter, a voltage source and means connected to said source for applying voltage to said heating element for heating said igniter upon demand as predetermined by said demand circuit, a heat sensing element, including heat responsive switching means, responsive to the temperature of said igniter electrical heating element, an electrical control circuit connected to said heat responsive switching means, a direct current voltage source and switching means for applying voltage from said voltage source to said hydrogen generator, said switch activated by said electrical control circuit upon said ignitor attaining a predetermined temperature, and gas valve outlet, and pressure sensing means on said hydrogen generator, said electrical control circuit, including means for actuating said outlet valve, to permit the generated gasses to be expelled from said nozzle upon said gasses generated by said hydrogen generator attaining a pretermined pressure, said expelled gasses from said nozzle, upon contact with said heated igniter, being ignited into a continuous flame, a second heat responsive sensory element positioned in the path of said ignited gasses including heat responsive switch means connected to said voltage source, disconnecting said voltage to said igniter electrical heating element upon said nozzle expelled gasses becoming ignited, and upon completion of demand, as predetermined by said demand circuit, said electrical control circuit disconnecting said direct current voltage to said hydrogen generator.

2. A start-up/shut-down circuit for use in a hydrogen generator gas burner system as set forth in claim 1 wherein said igniter is an electrical spark igniter, and wherein said heat sensing elements are thermo probes.

3. A start-up/shut-down circuit for use in a hydrogen generator gas burner system as set forth in claim 1 further comprising an override switch connected to said second heat responsive sensory element for actuating said override switch to terminate said voltage source to said heating element upon the absence of a flame.

* * * * *